US007377719B1

(12) United States Patent
Elizondo et al.

(10) Patent No.: US 7,377,719 B1
(45) Date of Patent: May 27, 2008

(54) CURB AND GUTTER SLED WITH PIVOTING MOLD ASSEMBLY

(75) Inventors: David D. Elizondo, Reno, NV (US); C. Ed Friberg, Reno, NV (US); Tim Hall, Reno, NV (US)

(73) Assignee: Northern Nevada Concrete, Inc., Reno, NV (US)

( * ) Notice: Subject to any disclaimer, the term of this patent is extended or adjusted under 35 U.S.C. 154(b) by 184 days.

(21) Appl. No.: 11/296,770

(22) Filed: Dec. 6, 2005

Related U.S. Application Data

(60) Provisional application No. 60/672,909, filed on Apr. 18, 2005.

(51) Int. Cl.
*E01C 11/22* (2006.01)
*E01C 19/52* (2006.01)

(52) U.S. Cl. ..... 404/98; 404/96; 404/97; 404/105; 404/110

(58) Field of Classification Search ..... 404/98, 404/96, 97, 105, 110
See application file for complete search history.

(56) References Cited

U.S. PATENT DOCUMENTS

| | | | | | |
|---|---|---|---|---|---|
| 2,932,875 | A * | 4/1960 | Butcher | 425/59 |
| 3,362,308 | A * | 1/1968 | Austin et al. | 425/64 |
| 3,507,015 | A * | 4/1970 | Heatlie | 425/64 |
| 3,530,552 | A * | 9/1970 | Calder | 425/62 |
| 3,635,131 | A * | 1/1972 | Larsen et al. | 404/84.1 |
| 3,797,958 | A | 3/1974 | Lofaro | |
| 3,820,913 | A * | 6/1974 | Miller et al. | 404/98 |
| 3,936,211 | A * | 2/1976 | Miller et al. | 404/104 |
| 3,954,359 | A * | 5/1976 | Larkin | 425/63 |
| 4,013,375 | A | 3/1977 | Heaton | |
| 4,197,032 | A * | 4/1980 | Miller | 404/98 |
| 4,526,493 | A * | 7/1985 | Hall et al. | 404/105 |
| 4,566,823 | A | 1/1986 | May | |
| 4,810,162 | A * | 3/1989 | Foster | 414/723 |
| 4,984,932 | A * | 1/1991 | Leone | 404/72 |
| 5,332,353 | A * | 7/1994 | Arnold | 414/723 |
| 5,662,431 | A * | 9/1997 | Colvard | 404/105 |
| 5,997,270 | A | 12/1999 | LaBonte | |
| 6,109,825 | A | 8/2000 | Yon | |
| 6,508,606 | B1 * | 1/2003 | James et al. | 404/98 |

(Continued)

OTHER PUBLICATIONS

Specification Sheet for LeeBoy Concrete Curber Series LBC24W, Feb. 2004.

(Continued)

*Primary Examiner*—Thomas B Will
*Assistant Examiner*—Alina Schiller
(74) *Attorney, Agent, or Firm*—John P. O'Banion

(57) ABSTRACT

A slipform sled for paving street curbs and gutters has a hopper and a curb and gutter mold. A pivoting mold assembly having a standard curb elevation mold and a driveway curb elevation mold is mounted on the slipform sled. The pivoting mold assembly pivots on a shaft oriented parallel to the direction of motion of the slipform sled. Paving material is flowed into the hopper and is extruded through the standard curb mold or the driveway curb mold while the sled is moving providing a smooth uniform finish. Only the relatively small transition section between the standard curb and driveway curb needs hand finishing. The elevation of a vibrator in the hopper is changed to correspond to the elevation of the curb extruded.

17 Claims, 3 Drawing Sheets

U.S. PATENT DOCUMENTS

| | | | | |
|---|---|---|---|---|
| 6,540,435 | B1 * | 4/2003 | Lizarraga | 404/98 |
| 6,709,195 | B2 * | 3/2004 | Piccoli et al. | 404/98 |
| 2003/0180092 | A1 * | 9/2003 | Piccoli et al. | 404/98 |

OTHER PUBLICATIONS http://powercurbers.com/PAGES/features.html, Features of Power Curber 5700-Super B, printed Apr. 28, 2005.

http://www.gomaco.com/Resources/gt6300_c_g.html, Brochure for Gomaco GT-6300 Curb and Gutter Machine, printed Apr. 28, 2005.

Larry Stewart, "Grade Controls Mold Curb-and-Gutter Machines", Construction Equipment, Apr. 28, 2005.

http://www.mbw.com/display/router.asp?docid=131, "Slipform Paver—Custom Molds", printed Apr. 28, 2005.

* cited by examiner

CURB AND GUTTER SLED WITH PIVOTING MOLD ASSEMBLY

CROSS-REFERENCE TO RELATED APPLICATIONS

This application claims priority from U.S. provisional application Ser. No. 60/672,909, filed on Apr. 18, 2005, incorporated herein by reference in its entirety.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

BACKGROUND OF THE INVENTION

1. Field of the Invention

This invention pertains generally to concrete slipform sleds, and more particularly to a sled for extruding curbs and gutters.

2. Description of Related Art

Curbs and gutters in new streets are typically formed by extruding a flowable paving material, such as concrete, through a slipform mold which conforms to the profile of the desired curb and gutter. Typically, the standard curb has an elevated rectangular profile adjacent to the gutter, which has a lower, relatively flat profile. A self propelled paving machine is typically used to extrude a continuous curb and gutter. A slipform sled having a hopper and the slipform is attached to the paving machine and positioned for a continuous pour. Flowable paving material is placed in the hopper of the sled and flows into the mold by gravity where it is extruded out behind the sled while the sled moves forward. Vibrators are typically placed in the hopper to help move the paving material into the mold, remove voids and produce a uniform surface on the extruded curb and gutter.

A driveway curb profile is typically lower than the standard curb. In some existing slipform sleds, when a driveway section needs to be made, a knife plate is inserted into the curb section mold to scrape the concrete extrusion to the driveway curb level. This knife plate causes the concrete extruded below it to come out with a ragged surface and little or no elevation control. The scraped driveway curb must be hand finished by first installing a form to the backside to establish the driveway curb elevation. The driveway curb is then floated to the form elevation, radius edges are installed and the curb surface smoothed with a trowel Taper forms are used to finish the transition from standard curb to driveway curb.

In another configuration of existing curb and gutter paving systems, a tail piece is lowered behind the slip mold to cut or squeeze the curb extrusion to a lower elevation. In other systems a plate within the slip mold is lowered in elevation for a driveway curb. These methods depend on the travel of a hydraulic cylinder actuator pressing against extruded paving material to be uniform for each change of elevation. Unfortunately, these systems do not exhibit consistent uniform elevation control. They typically result in wasted concrete and usually leave a rough, uneven curb surface that requires form leveling and significant hand finishing. In still further systems, the sled must stop and the slipform mold exchanged to the desired curb profile for each driveway transition.

In a new home development, dozens of driveway sections may be installed in the curbs and gutters paved in a single day. With existing equipment, this requires many starts and stops to exchange molds or significant labor to set forms and hand finish the driveway curb elevations.

What is needed is a slipform sled that can extrude both the standard elevation curb and a lower elevation driveway curb reliably and without requiring significant finishing by hand.

BRIEF SUMMARY OF THE INVENTION

A pivoting mold assembly on a slip mold sled that changes between a standard curb elevation and a driveway curb elevation while the sled is moving and extruding concrete. Only the relatively small transition section between the standard curb and driveway curb needs hand finishing. The invention eliminates the need to install forms along the driveway curb and the need to hand finish the driveway section.

The vertical position of the hopper vibrator for the curb portion of the mold can be changed to match the elevation of the curb mold in use.

An embodiment of the invention is an apparatus for extruding a continuous curb that comprises slipform sled, a hopper coupled to the slipform sled, where the hopper is adapted to receive a flowable paving material, a pivoting mold coupled to the slipform sled, where the pivoting mold is fluidly connected to the hopper, where the pivoting mold has a first position and a second position, where when the pivoting mold is in the first position, a curb of a first profile is extruded, where when the pivoting mold is in the second position, a curb of a second profile is extruded, and where the pivoting mold is adapted to change from the first position to the second position when the slipform sled is in motion and flowable paving material is flowing from the hopper to the pivoting mold.

An aspect of the invention is where the pivoting mold pivots on an axis parallel to the direction of motion of the slipform sled.

Another aspect of the invention is where the pivoting mold pivots by means of a hydraulic actuator.

A further aspect of the invention is a shaft supporting the pivoting mold and coupled to the slipform sled, where the shaft is oriented parallel to the direction of motion of the slipform sled.

A still further aspect of the invention is a hydraulic actuator coupled to the slipform sled and further coupled to the shaft, where the hydraulic actuator moves the pivoting mold between the first position and the second position.

Another aspect of the invention is a vibrator positioned in the hopper, where the vibrator is adapted to vibrate flowable paving material, where the vibrator has a first position and a second position, where the first position of the vibrator corresponds to a curb of the first profile, and where the second position of the vibrator corresponds to a curb of the second profile.

A further aspect of the invention is a first hydraulic actuator coupled to the shaft, where the first hydraulic actuator moves the pivoting mold between the first and second positions and a second hydraulic actuator coupled to the vibrator, where the second hydraulic actuator moves the vibrator between the first and second positions.

Another embodiment of the invention is a slipform sled, a hopper coupled to the slipform sled, where the hopper is adapted to receive a flowable paving material, means for forming a curb coupled to the slipform sled, where the means for forming a curb is fluidly connected to the hopper, where flowable paving material flows from the hopper into the means for forming a curb when the slipform sled is in motion, where the means for forming a curb has a first position and a second position, where when the means for forming a curb is in the first position, a curb of a first profile is extruded, where when the means for forming a curb is in the second position, a curb of a second profile is extruded, and where the means for forming a curb is adapted to change between the first position and the second position when the slipform sled is in motion.

Another aspect of the invention is where the means for forming a curb comprises a pivoting mold coupled to the slipform sled, and a shaft supporting the pivoting mold and coupled to the slipform sled, where the pivoting mold rotates on the shaft, and where the shaft is oriented parallel to the direction of motion of the slipform sled.

A further aspect of the invention is a hydraulic cylinder having a base and an actuator, the hydraulic cylinder base coupled to the slipform sled, the hydraulic cylinder actuator coupled to the shaft, where the hydraulic cylinder is used to change the pivoting mold between the first position and the second position.

A still further aspect of the invention is a vibrator positioned in the hopper, the vibrator adapted to vibrate flowable paving material, where the vibrator has a first position and a second position, where the first position of the vibrator corresponds to a curb of the first profile, and where the second position of the vibrator corresponds to a curb of the second profile.

Another aspect of the invention is where the means for forming a curb comprises a front and rear plate, where the front, rear plates are shaped as a wedge having a vertex and an arcuate outer edge opposite the vertex, an aperture positioned in the vertex of the front, rear plates, a shaft coupled to the slipform sled, where the front, rear plates are mounted on the shaft through the apertures, where the front, rear plates are aligned on a common plane perpendicular to the shaft, the outer edge of the front, rear plates having left and right sections, a first cutout positioned in the left section of the outer edge of the front, rear plates, a first curb slipform mounted between the front and rear plates and extending from the first cutout in the front plate to the first cutout in the rear plate, where the first curb slipform corresponds to a curb of the first profile, a second cutout positioned in the right section of the outer edge of the front, rear plates, a second curb slipform mounted between the front and rear plates and extending from the second cutout in the front plate to the second cutout in the rear plate, where the second curb slipform corresponds to a curb of the second profile, and where the first and second curb slipforms are oriented parallel to the shaft.

A further aspect of the invention is a middle plate positioned between the front and the rear plates, where the middle plate is mounted on the shaft on a plane perpendicular to the shaft, and where the middle plate is coupled to the first and second curb slipforms.

A still further aspect of the invention is a front wear plate coupled to the front plate, and a rear wear plate coupled to the rear plate.

A further embodiment of the invention is in an apparatus for forming an extruded curb consisting of a slipform sled and a hopper adapted to receive a flowable paving material, where the improvement comprises a pivoting mold coupled to the slipform sled, where the pivoting mold is fluidly coupled to the hopper, where the pivoting mold is adapted to form an extruded curb, where flowable paving material flows from the hopper into the pivoting mold when the slipform sled is in motion, where the pivoting mold has a first position and a second position, where when the pivoting mold is in the first position, a curb of a first profile is extruded, where when the pivoting mold is in the second position, a curb of a second profile is extruded, where the pivoting mold is adapted to change from the first position to the second position when the slipform sled is in motion, and where the pivoting mold is adapted to rotate on an axis parallel to the direction of motion of the slipform sled.

Another embodiment of the invention is a method of forming an extruded curb having first and second elevations that comprises providing a slipform sled having a hopper and a pivoting mold, the pivoting mold having a first position and a second position, where in the first position, the pivoting mold extrudes a curb of a first elevation, where in the second position, the pivoting mold extrudes a curb of a second elevation, where the pivoting mold is configured to pivot between the first position and the second position on an axis parallel to the direction of motion of the slipform sled, moving the slipform sled to extrude a curb of first elevation, pivoting the pivoting mold from the first position to the second position to extrude a curb of second elevation.

Another aspect of the invention is pivoting the pivoting mold between the first position and the second position while the slipform sled is moving.

A further aspect of the invention is providing a vibrator in the hopper, where the vibrator has a first position and a second position, where the first position of the vibrator corresponds to a curb of the first elevation, where the second position of the vibrator corresponds to a curb of the second elevation, moving the vibrator to the first position when the pivoting mold is moved to the first position, and moving the vibrator to the second position when the pivoting mold is moved to the second position.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

Figure 1:
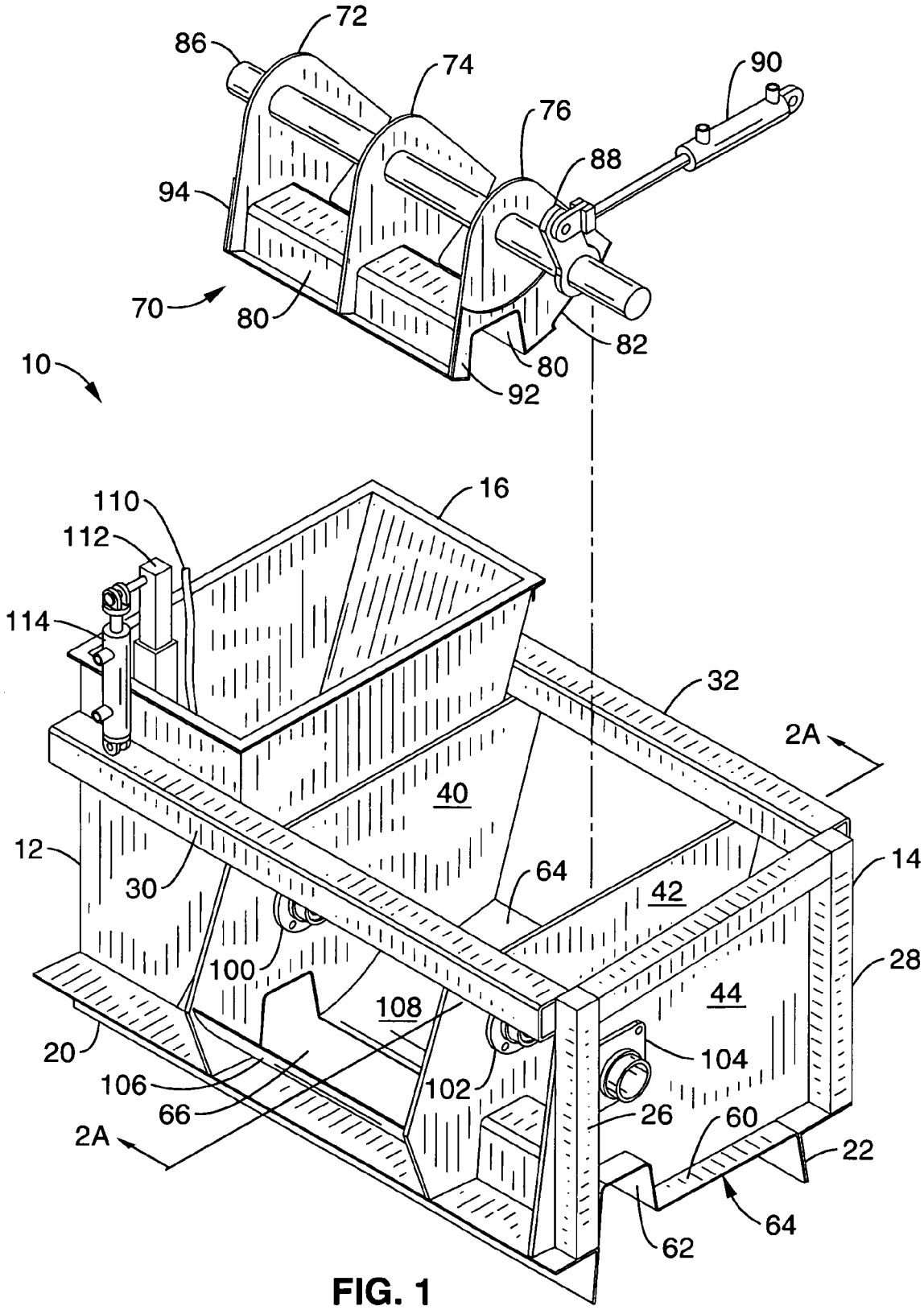
FIG. 1 is an exploded perspective view of a slipform sled with a pivoting mold assembly according to an embodiment of the invention.
Figure 2A:
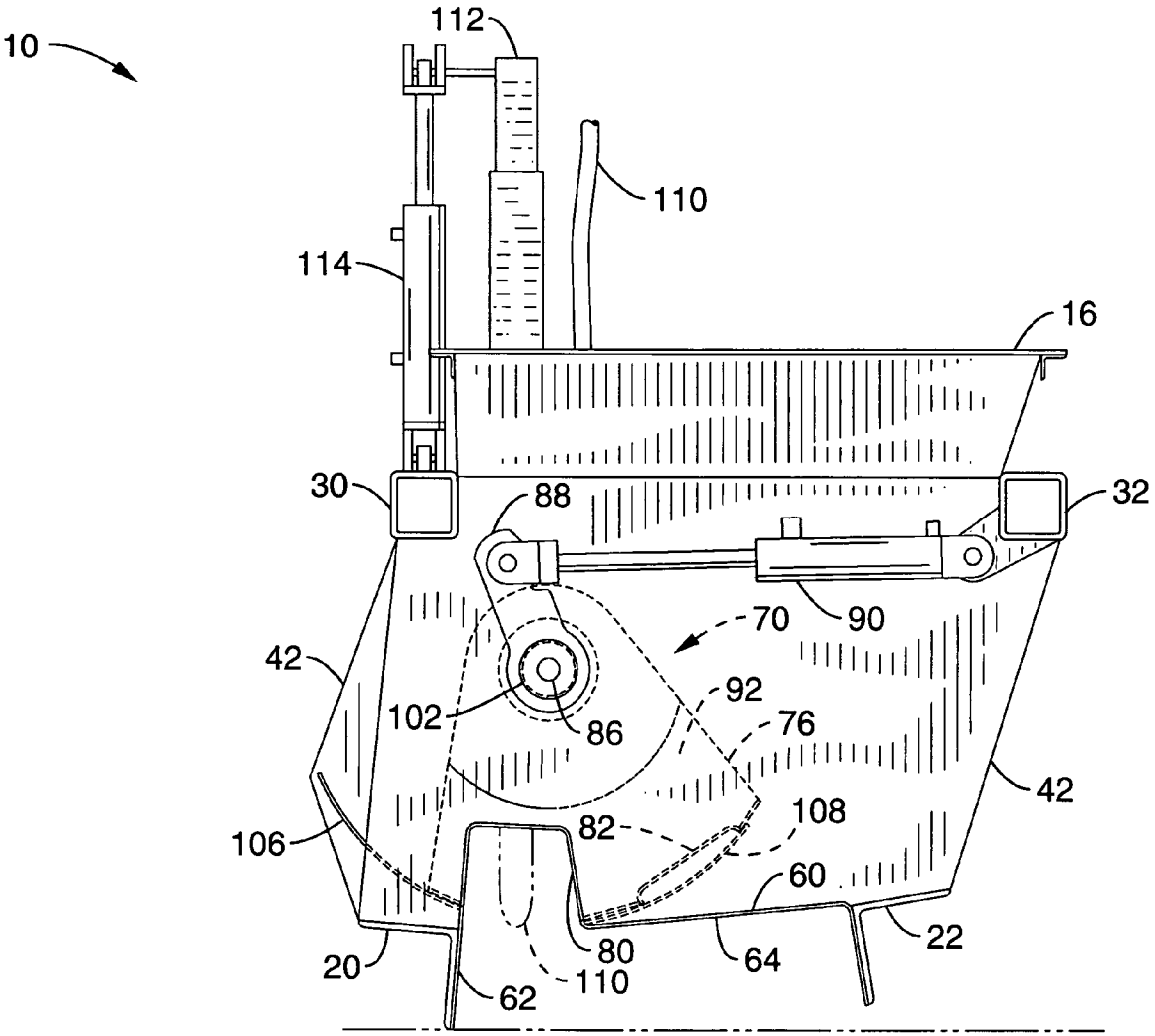
FIG. 2A is a cross section view of the slipform sled shown in FIG. 1 taken at line 2A-2A with the pivoting mold assembly in the elevated curb position.
Figure 2B:
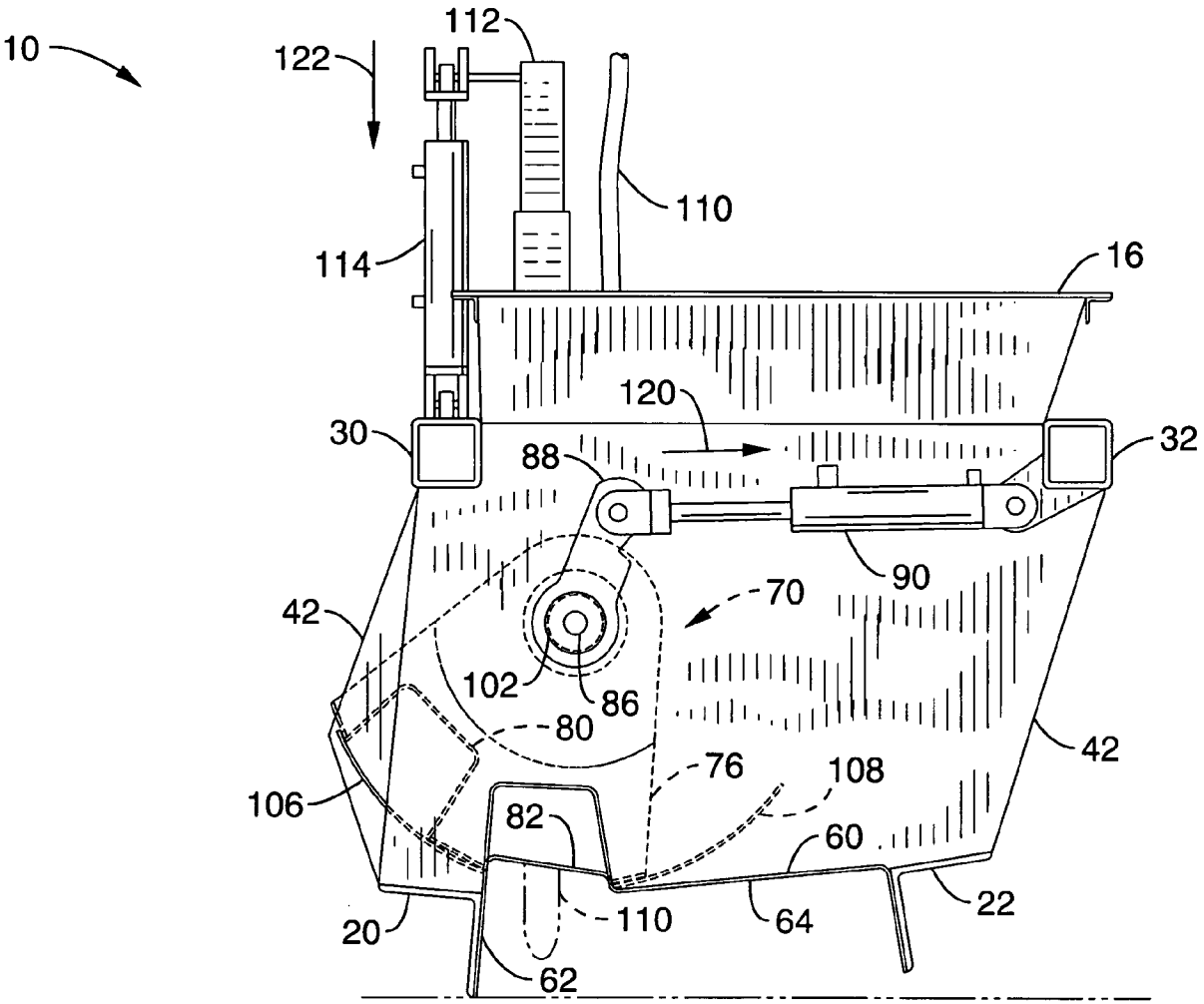
FIG. 2B is the cross section view of the slipform sled shown in FIG. 2A with the pivoting mold assembly in the depressed curb position.

Referring more specifically to the drawings, for illustrative purposes the present invention is embodied in the apparatus generally shown in FIG. 1 through FIG. 2B. It will be appreciated that the apparatus may vary as to configuration and as to details of the parts, and that the method may vary as to the specific steps and sequence, without departing from the basic concepts as disclosed herein.

FIG. 1 illustrates an exploded perspective view of a slipform sled 10 according to an embodiment of the invention. Sled 10 is configured to be mounted on an existing powered curb paving machine. Sled 10 is generally rectangular and has a front end 12 and back end 14. A rectangular hopper 16 is mounted at front end 12 and holds the flowable paving mixture used to extrude a continuous curb and gutter. In one embodiment, sled 10 is about six feet to about twelve feet long and hopper 16 is about two feet to about three feet long and about 2.5 feet wide.

Structural support for sled 10 consists of left bottom rail 20 and right bottom rail 22 running front to back on the bottom of sled 10. Left, right bottom rails 20, 22 are coupled to hopper 16 at front end 12. At back end 14 are left right columns 26, 28 coupled to left, right bottom rails 20, 22 respectively. Also running front to back is left, top rail 30 and right top rail 32 that extend from front end 12 at hopper 16 to left, right columns 26, 28 respectively. Left, right top rails 30, 32 are used to suspend sled 10 from a power curb paving machine during operation.

In one embodiment, left, right bottom rails 20, 22 are made of 6" by 6" angle iron and left, right top rails 30, 32 are made of 4" by 4" box steel. Additional frames, rails or couplings may be attached to sled 10 to conform with existing mounting methods of powered curb pouring machines without departing from the teachings of this invention.

Behind hopper 16 is a front bucket frame plate 40 that is supported by left, right bottom rails 20, 22 and left, right top rails 30, 32. Moving about two feet to about four feet rearward is rear bucket frame plate 42, parallel to front bucket frame plate 40 and also supported by left, right bottom rails 20, 22 and left, right top rails 30, 32. At back end 14 is rear frame plate 44 supported by left, right bottom rails 20, 22 left, right top rails 30, 32, and left, right columns 26, 28.

A curb and gutter slipform 60 having a curb portion 62 and a gutter portion 64 is mounted between left, right bottom rails 20, 22. The curb portion 62 with a generally rectangular profile extends from rear frame plate 44 to rear bucket frame plate 42. The curb portion 62 of slipform 60 is removed between front bucket frame plate 40 and rear bucket frame plate 42 to form opening 66. Curb portion 62 of slip form 60 also extends from front bucket frame plate 40 into hopper 16. Gutter portion 64 of slipform 60 has a relatively flat profile and extends from rear frame plate 44 through rear and front bucket frame plates 42, 40 and into hopper 16.

A pivoting mold assembly 70, also referred to herein as a bucket, has three, wedge shaped plates comprising front 72, middle 74 and rear 76 bucket plates respectively. The bucket plates are radiused at the vertex and have an arcuate bottom edge at a constant radius from the vertex. Front, middle and rear bucket plates 72, 74, 76 are aligned in parallel from about one foot to about two feet apart. The bottom left edge of each bucket plate is cut out to support an elevated curb mold 80 that extends from front bucket plate 72 to rear bucket plate 76. Elevated curb mold 80 has a profile that corresponds to curb portion 62 of slip mold 60 and aligns in opening 64 in slipform sled 10.

The bottom right edge of each bucket plate is cut out to support a depressed curb mold 82 that extends from front bucket plate 72 to rear bucket plate 76 and aligns in opening 64 in slipform sled 10. Depressed curb mold 82 corresponds to a driveway, pedestrian ramp or other curb profile of a lower elevation. A shaft 86 extends through apertures in the apex of front, middle and rear bucket plates 72, 74, 76. In one embodiment, shaft 86 is about 2 inches in diameter. When assembled, each aforementioned plate is keyed to shaft 86 by a keyed collar, welding or other means. A bell crank 88 is positioned on shaft 86 behind rear bucket plate 76. A hydraulic cylinder 90 is positioned with the actuator shaft coupled to bell crank 88 and, when assembled, the base is coupled to top rail 32 (see FIG. 2A).

Also shown on the outside bottom of rear bucket plate 76 is removeable rear wear plate 92. A similar front wear plate 94 is attached to front bucket plate 72. Corresponding wear plates may be attached to front bucket frame plate 40 and rear bucket frame plate 42 on sled 10, but are not shown here for clarity. Additional reinforcement such as rods or struts may be positioned between front, middle and rear bucket plates 72, 74, 76 but are not shown for clarity.

When assembled on sled 10, pivoting mold assembly 70 is positioned between front bucket frame plate 40 and rear bucket frame plate 42. Bell crank 88 is keyed on shaft 86 between rear bucket frame plate 42 and rear frame plate 44. Shaft 86 is supported on aligned first, second and third bearings 100, 102, 104 attached to front, rear bucket frame plate 40, 42 and rear frame plate 44 respectively.

A left radius plate 106 is shown positioned between front bucket frame plate 40 and rear bucket frame plate 42 and positioned to correspond to the arcuate outer edge radius of pivoting mold assembly 70. A corresponding right radius plate 108 is positioned between front bucket frame plate 40 and rear bucket frame plate 42.

A flexible shaft vibrator 110 is typically suspended in hopper 16 with the vibrating end at an elevation that corresponds with the curb portion 62 of slipform 60. Vibrator 110 is used to help move the paving material from hopper 16 into the mold, remove voids and produce a uniform smooth surface on the extruded curb and gutter. (A second flexible shaft vibrator for gutter portion 64 of slipform 60 may also be used but is not shown for clarity). A vibrator support bracket 112 in hopper 16 is coupled to hydraulic cylinder 114 positioned on top of hopper 16. When depressed curb mold 82 is aligned with curb portion 62 of slipform 60, hydraulic cylinder 114 can lower the end of vibrator 110 to correspond with the lower elevation of depressed curb slipform 82.

FIG. 2A is a cross section view of sled 10 taken at line 2A-2A shown in FIG. 1 looking forward and shows pivoting mold assembly 70 in the elevated curb position. Rear bucket plate 76, shown in phantom, is keyed to shaft 86 and is shown supported on bearing 102 in rear bucket frame plate 42. Hydraulic cylinder 90 is coupled to top rail 32 and is in the extended position so that elevated curb mold 80 is aligned with the curb portion 62 of curb and gutter slipform 60. Note that the travel of the actuator arm of hydraulic cylinder 90 establishes the position of elevated curb mold 80 but not the elevation. Hydraulic cylinder 114 is in the extended position so that vibrator 110 is suspended centrally in the elevated curb portion of slipform 62 by vibrator support 112.

FIG. 2B is a cross section view of sled 10 taken at line 2A-2A shown in FIG. 1 and shows pivoting mold assembly 70 in the depressed curb position. Hydraulic cylinder 90 has retracted in the direction indicated by arrow 120 reacting with bell crank 88 to rotate pivoting mold assembly 70 so that depressed curb mold 82 is aligned with curb portion 62 of slipmold 60. Hydraulic cylinder 114 has retracted in direction of arrow 122 so that vibrator support 112 positions the end of vibrator 110 lower in hopper 16 and centrally in relation with the position of depressed curb mold 82. A smooth driveway curb at a constant elevation is extruded through depressed curb mold 82.

Pivoting mold assembly 70 can change position while sled 10 is in motion. One advantage of this pivoting mold configuration is the axis of rotation of the pivoting mold assembly 70 is parallel to the direction of travel. This makes the elevation of the depressed curb constant with respect to shaft 86 and the position of sled 10 and not dependent on the position of a hydraulic actuator or adjustable stops. Further, the structural position of shaft 86 vertically over the mold prevents any vertical movement of the mold relative to the slipform sled, such as may be experienced with adjustable molds on actuator shafts or knife plates that extend behind the sled. Because the axis of rotation of pivoting mold assembly 70 is parallel to the direction of travel, paving material already extruded into the curb is not squeezed downward but is pushed sideways and onto radius plate 106 when the depressed curb mold is moved into position. This eliminates deformation of paving material into the gutter portion that would otherwise require hand finishing.

Both the elevated curb mold 80 and depressed curb mold 82 provide smooth extruded surfaces at a constant elevation relative to the sled so that only the small transition area between the curb elevations, created when the mold is pivoted, needs subsequent hand finishing. The transition curb area is typically about the length of pivoting mold assembly 70.

In a contemplated embodiment (not shown), pivoting mold assembly 70 has three or more molds for three or more curb elevations or configurations such as rounded curbs or ramps. In another contemplated embodiment, a pivoting mold assembly is added for the gutter portion of the mold, such as for a catch basin or other desired change in the gutter profile.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. An apparatus for extruding a continuous curb comprising:
- a slipform sled;
- a hopper coupled to said slipform sled;
- wherein said hopper is adapted to receive a flowable paving material;
- a pivoting mold coupled to said slipform sled;
- wherein said pivoting mold is fluidly connected to said hopper;
- wherein said pivoting mold has a first position and a second position;
- wherein when said pivoting mold is in said first position, a curb of a first profile is extruded;
- wherein when said pivoting mold is in said second position, a curb of a second profile is extruded;
- wherein said pivoting mold is adapted to change from said first position to said second position when said slipform sled is in motion and flowable paving material is flowing from said hopper to said pivoting mold; and
- wherein said pivoting mold pivots on an axis parallel to the direction of motion of said slipform sled.

2. An apparatus as recited in claim 1, wherein said pivoting mold pivots by means of a hydraulic actuator.

3. An apparatus as recited in claim 1, further comprising:
- a shaft supporting said pivoting mold and coupled to said slipform sled;
- wherein said shaft is oriented parallel to the direction of motion of said slipform sled.

4. An apparatus as recited in claim 3, further comprising:
- a hydraulic actuator coupled to said slipform sled and further coupled to said shaft;
- wherein said hydraulic actuator moves said pivoting mold between said first position and said second position.

5. An apparatus as recited in claim 1, further comprising:
- a vibrator positioned in said hopper;
- wherein said vibrator is adapted to vibrate flowable paving material;
- wherein said vibrator has a first position and a second position;
- wherein said first position of said vibrator corresponds to a curb of said first profile; and
- wherein said second position of said vibrator corresponds to a curb of said second profile.

6. An apparatus as recited in claim 5, further comprising:
- a shaft supporting said pivoting mold and coupled to said slipform sled;
- wherein said shaft is oriented parallel to the direction of motion of said slipform sled.

7. An apparatus as recited in claim 6, further comprising:
- a first hydraulic actuator coupled to said shaft;
- wherein said first hydraulic actuator moves said pivoting mold between said first and second positions; and
- a second hydraulic actuator coupled to said vibrator;
- wherein said second hydraulic actuator moves said vibrator between said first and second positions.

8. An apparatus for extruding a continuous curb comprising:

a slipform sled;

a hopper coupled to said slipform sled;

wherein said hopper is adapted to receive a flowable paving material;

means for forming a curb coupled to said slipform sled;

wherein said means for forming a curb is fluidly connected to said hopper;

wherein flowable paving material flows from said hopper into said means for forming a curb when said slipform sled is in motion;

wherein said means for forming a curb has a first position and a second position;

wherein when said means for forming a curb is in said first position, a curb of a first profile is extruded;

wherein when said means for forming a curb is in said second position, a curb of a second profile is extruded;

wherein said means for forming a curb is adapted to change between said first position and said second position when said slipform sled is in motion;

a pivoting mold coupled to said slipform sled;

a shaft supporting said pivoting mold and coupled to said slipform sled;

wherein said pivoting mold rotates on said shaft; and wherein said shaft is oriented parallel to the direction of motion of said slipform sled.

9. An apparatus as recited in claim 8, further comprising:

a hydraulic cylinder having a base and an actuator;

said hydraulic cylinder base coupled to said slipform sled;

said hydraulic cylinder actuator coupled to said shaft;

wherein said hydraulic cylinder is used to change said pivoting mold between said first position and said second position.

10. An apparatus as recited in claim 8, further comprising:

a vibrator positioned in said hopper;

said vibrator adapted to vibrate flowable paving material;

wherein said vibrator has a first position and a second position;

wherein said first position of said vibrator corresponds to a curb of said first profile; and wherein said second position of said vibrator corresponds to a curb of said second profile.

11. An apparatus as recited in claim 8, wherein said means for forming a curb comprises:

a front and rear plate;

wherein said front, rear plates are shaped as a wedge having a vertex and an arcuate outer edge opposite said vertex;

an aperture positioned in said vertex of said front, rear plates;

a shaft coupled to said slipform sled;

wherein said front, rear plates are mounted on said shaft through said apertures;

wherein said front, rear plates are aligned on a common plane perpendicular to said shaft;

said outer edge of said front, rear plates having left and right sections;

a first cutout positioned in said left section of said outer edge of said front, rear plates;

a first curb slipform mounted between said front and rear plates and extending from said first cutout in said front plate to said first cutout in said rear plate;

wherein said first curb slipform corresponds to a curb of said first profile;

a second cutout positioned in said right section of said outer edge of said front, rear plates;

a second curb slipform mounted between said front and rear plates and extending from said second cutout in said front plate to said second cutout in said rear plate;

wherein said second curb slipform corresponds to a curb of said second profile; and wherein said first and second curb slipforms are oriented parallel to said shaft.

12. An apparatus as recited in claim 11, further comprising:

a middle plate positioned between said front and said rear plates;

wherein said middle plate is mounted on said shaft on a plane perpendicular to said shaft; and wherein said middle plate is coupled to said first and second curb slipforms.

13. An apparatus as recited in claim 11, further comprising:

a front wear plate coupled to said front plate; and a rear wear plate coupled to said rear plate.

14. In an apparatus for forming an extruded curb consisting of a slipform sled and a hopper adapted to receive a flowable paving material, the improvement comprising:

a pivoting mold coupled to said slipform sled;

wherein said pivoting mold is fluidly coupled to said hopper;

wherein said pivoting mold is adapted to form an extruded curb;

wherein flowable paving material flows from said hopper into said pivoting mold when said slipform sled is in motion;

wherein said pivoting mold has a first position and a second position;

wherein when said pivoting mold is in said first position, a curb of a first profile is extruded;

wherein when said pivoting mold is in said second position, a curb of a second profile is extruded;

wherein said pivoting mold is adapted to change from said first position to said second position when said slipform sled is in motion; and wherein said pivoting mold is adapted to rotate on an axis parallel to the direction of motion of said slipform sled.

15. In an apparatus as recited in claim 14, the improvement further comprising:

a shaft supporting said pivoting mold and coupled to said slipform sled;

wherein said shaft is oriented parallel to the direction of motion of said slipform sled.

16. In an apparatus as recited in claim 15, the improvement further comprising:

a hydraulic actuator coupled to said slipform sled and further coupled to said shaft;

wherein said hydraulic actuator moves said pivoting mold between said first position and said second position.

17. In an apparatus as recited in claim 14, the improvement further comprising:

a vibrator positioned in said hopper;

said vibrator adapted to vibrate flowable paving material;

wherein said vibrator has a first position and a second position;

wherein said first position of said vibrator corresponds to a curb of said first profile; and wherein said second position of said vibrator corresponds to a curb of said second profile.

* * * * *